United States Patent [19]

Laprade et al.

[11] 4,002,704

[45] Jan. 11, 1977

[54] CARBURETOR

[75] Inventors: Bernard R. Laprade; Xavier J. Laprade, both of Arudy; Pierre J. Gele, Laloubere, all of France

[73] Assignees: Societe Nationale des Petroles d'Aquitaine, Tour Aquitaine Paris la Defense; Les Usines Laprade, Arudy, both of France

[22] Filed: June 12, 1974

[21] Appl. No.: 478,600

[30] Foreign Application Priority Data

June 29, 1973 France ..... 73.23919

[52] U.S. Cl. ..... 261/23 A; 261/50 A

[51] Int. Cl.[2] ..... F02M 11/02

[58] Field of Search ..... 261/50 A, 23 A

[56] References Cited

UNITED STATES PATENTS

| | | | |
|---|---|---|---|
| 1,040,528 | 10/1912 | Dock | 261/50 A |
| 1,080,696 | 12/1913 | Huguelet | 261/50 A |
| 1,186,166 | 6/1916 | Bennett | 261/50 A |
| 1,200,315 | 10/1916 | Coulombe | 261/50 A |
| 1,281,446 | 10/1918 | Weaver | 261/50 A |
| 1,352,628 | 9/1920 | Rayfield | 261/50 A |
| 2,638,330 | 5/1953 | Morgenroth | 261/23 A |
| 3,198,498 | 8/1965 | Mennesson | 261/50 A |
| 3,342,464 | 9/1967 | Mick | 261/50 A |
| 3,512,508 | 5/1970 | Winker | 261/50 A |
| 3,721,428 | 3/1973 | Gele et al. | 261/50 A |
| 3,778,041 | 12/1973 | Kincade | 261/50 A |
| 3,869,528 | 3/1975 | Mick | 261/50 A |

*Primary Examiner*—Tim R. Miles
*Attorney, Agent, or Firm*—Finnegan, Henderson, Farabow & Garrett

[57] ABSTRACT

The adjustable aperture of a petrol metering element of a carburetor for internal combustion engines discharges directly into the body of the carburetor and is centered substantially on the geometrical axis of the stream of air in the said body, the petrol clearance height not being greater than about 10 mm.

7 Claims, 8 Drawing Figures

7
7b
7a
9
19b
19a
10b
10a
15b
15a
8b
8a
12b
12a
13b
13a
20

% Co
14
13
12
11
10
9
8
7
6
5
4
3
2
1
0
32
30
31
Δ 1500 t/min
x 2000 t/min
• 3000 t/min
0
1
2
3
4
5
6
mm mkg
11
10
9
8
• 1500 t/min
x 2000 t/min
Δ 3000 t/min
0
1
2
3
4
5
6 mm % Co
13
12
11
10
9
8
7
6
5
4
3
2
1
0
32
30
A
B mkg
11
10
9
8
A
B

CARBURETOR

BACKGROUND OF THE INVENTION

The achievement of correct fuel supply to the cylinders of an internal combustion engine is a difficult problem the acuteness of which has become particularly great because of the pollution which accompanies any defective carburation. Incomplete solutions, which make it possible to obtain the desired power at the expense of increased consumption, are no longer acceptable at the present time because of the increased content of harmful gases which they produce in the exhaust emission.

The object of the present invention is an improved carburetor in which the petrol supply conditions are so established that the homogeneity and the degree of atomization of the mixture reaching the cylinders are greatly improved, these two conditions being fundamental for good carburation.

In known carburetors, for example those of the fixed jet type such as that shown in FIG. 1 of the accompanying drawings, there are always provided a petrol jet 1 and an air jet 2 which effect the formation of an emulsion, which can be considered as a compressible medium in which the waves are propagated at a speed close to that of sound in air, that is to say 300 meters per second. (In the case considered the wave in question is a negative pressure wave.)

The negative pressure wave produced by the suction of the cylinders is therefore propagated in the induction manifold 3 at about 300 meters per second and, as a rough approximation, the same speed can be accepted for the propagation of this wave, at the level of the diffuser 4, through the spray nozzle 6 in order to reach the petrol level 5 and the initiate the stream of petrol. By the expression "petrol level" must be understood the level assumed by the petrol under operating conditions. The distance usually adopted in carburetors of this kind between the center of the stream of air in the diffuser and the point 5 where the mean petrol level is established is of the order of 35 to 40 mm, and in all cases is greater than 30 mm.

In normal petrol internal combustion engines the priming of the main circuit is established at about 1500 r.p.m. At this speed the duration of one rotation of the crankshaft through 1° is 1/9000 second and the time taken by the negative pressure wave during the induction phase to reach the petrol level from the diffuser is at least equal to $$t = \frac{1 \text{ sec} \times 30}{300 \times 10^3} = \frac{1}{10^4} = 1/10000 \text{ sec.}$$

At 1500 r.p.m. this corresponds to a crankshaft rotation of at least about 1°.

It is then necessary that the petrol should reach the neck of the diffuser 4; since the difference in pressure between the neck of the diffuser and the petrol level is low (of the order of 100 g at most) the speed of circulation of the emulsion will be substantially lower than the speed of circulation of the driving wave.

The time necessary for the petrol to travel the distance separating the center of the diffuser 4 from the level 5 will therefore correspond to an additional magnitude of crankshaft rotation additive to the previous mentioned crankshaft rotation.

Starting from the moment when the system is primed, the negative pressure wave is propagated through an emulsion the speed of which slows down the propagation of the negative pressure wave, so that this minimum figure is further increased.

Furthermore, the petrol level becomes lower, the higher the speed of the engine, so that the phenomenon is intensified.

It can therefore be taken as certain that the emulsion flow wave will lag behind the negative pressure wave by a time greater than the duration of crankshaft rotation during transmission of the negative pressure wave. The negative pressure wave corresponds to the flow wave of the air introduced into the engine. Consequently, the air introduced during initial crankshaft rotation will not be carburetted and the flow of petrol will continue while the flow of air will be interrupted by the falling of the suction valve.

This delay is intensified by the fact that at the moment when the air flow is interrupted in the diffuser atomization becomes very poor. Thus, in the last part of the air and petrol flow wave passing through the zone between the diffuser and the inlet valve, not only will the mixture be rich, but it will be poorly or only slightly atomized, so that bad carburation will result.

SUMMARY OF THE INVENTION

The carburetor according to the invention results from the systematic study of this problem and tends to remedy the disadvantages described below.

It comprises essentially a carburetor of the constant vacuum type in which the adjustable aperture of the petrol metering device dsicharges directly into the body of the carburetor and is centered on the geometrical axis of the stream of air in the same body, while the petrol clearance height is not greater than about 10 mm.

The expression "constant vacuum carburetor" designates a known carburetor in which upstream of the main throttle flap or throttle device operated by the driver there is provided an auxiliary throttle device which opens automatically and progressively in proportion to the increase of the flow of air passing through the passage, in such a manner as to keep at a substantially constant level the vacuum prevailing between the two throttle elements. The auxiliary throttle element controls a metering device regulating the flow of fuel, which is drawn in by suction through a passage having its outlet between the two throttle elements.

The expression "petrol metering device" designates an element such as a tapered needle the movement of which in a calibrated aperture controls the flow of petrol, or any other equivalent device. What is essential in respect of the invention is that the petrol flow adjusting aperture should be identical with the aperture through which the petrol is atomized into the stream of air, should be subject to the direction action of the stream of air passing through the carburetor, and should be situated on the geometrical axis of this stream of air.

It is also for this reason that the carburetor according to the invention is of the constant vacuum type. In the case of static carburetors, it is in fact necessary to provide means for achieving correct regulation of the flow of petrol in dependence on the flow of air, which leads to the provision, upstream of the petrol outlet, of an auxiliary air inlet and an emulsion system, and the dimensions of these devices cannot be reduced beyond certain limits. On the other hand, in the case of constant vacuum carburetors the flow of petrol is controlled by purely mechanical means through the movements of the auxiliary throttle element, thus making it possible for the adjustable aperture controlling the flow of petrol to discharge direct into the air stream.

The expression petrol clearance height designates the difference in level between the aperture of the petrol metering means and the level of petrol in the chamber of the carburetor.

The combination according to the invention makes it possible for carburation to be considerably improved. Since in fact the petrol is delivered direct to the center of the air stream passing through the body of the carburetor, the negative pressure wave acts on it without any of the delays indicated at the beginning of the present description.

Furthermore, the clearance height must not be greater than about 10 mm. because above this value the vacuum due to the height of the column of petrol which has to be drawn in and the inertia of this column couteracts the effects obtained by the above described arrangement, to such an extent as to annihilate them.

The invention also relates to the arrangements described below.

a. The expression situated on the geometrical axis of a stream of air passing through the body of the carburetor means that the distance between the aperture of the petrol metering element and the geometrically centered axis of the passage is at most equal to 5 mm and preferably less than 2 mm.

b. The constant vacuum carburetor is a twin body carburetor, that is to say of the type comprising a main body of smaller diameter and an auxiliary body of smaller diameter both bodies being situated downstream of the auxiliary throttle element and both having a main throttle element, the main throttle element of the auxiliary body being controlled by the driver; the petrol admission aperture is situated in the auxiliary body upstream of its main throttle element, while the main throttle element of the main body is arranged to open with a time lag in relation to the main throttle element of the auxiliary body, particularly through the effect of the increase of vacuum; and the auxiliary body is so disposed and shaped that its downstream portion is coaxial to and situated inside the main body, the adjustable aperture of the petrol metering element discharging directly into this downstream portion and being situated on the geometrical axis of this downstream portion of the auxiliary body.

c. The carburetor is of the twin-body type as described above, and in it the auxiliary body contains, upstream of the aperture of the metering element, a supplementary offset throttle element which is returned elastically by means adjustable in dependence on various parameters (temperature, pressure, temperature and carbon monoxide content of the exhaust gases, temperature of the catalyst or thermal reactor); the two main throttle elements are connected in such a manner that the main throttle element of the main body opens only starting from a predetermined aperture of the main throttle element of the auxiliary body, the connection being of mechanical and/or pneumatic type; the auxiliary throttle element is subjected to the correcting action of the vacuum prevailing immediately upstream of this element, by means of a pressure capsule; and the auxiliary body is so disposed that its dowstream portion is inside and coaxial to the main body, the adjustable aperture of the petrol metering element discharging directly into this downstream portion and being situated on the geometrical axis of this upstream portion of the main body.

d. The carburetor is of the constant vacuum, twin-body type, comprising a main body of large diameter and an auxiliary body of smaller diameter, both these bodies being situated downstream of the auxiliary throttle element which opens automatically and progressively in proportion as the air flow increases, and it is characterised in that each body contains a metering element controlled by the auxiliary throttle element, the adjustable aperture of the metering element of the main body discharging directly into the main body on the geometrical axis of the air stream passing through it, while the adjustable aperture of the metering element of the auxiliary body discharges directly into the latter on the geometrical axis of the air stream passing through it, the main throttle elements of the main and auxiliary bodies being both situated downstream of the said adjustable apertures and both being directly controlled by the driver, the petrol clearance height in each body being at most equal to about 10 mm.

e. The carburetor is in conformity with paragraph (b) above, and each body contains upstream of the adjustable aperture an additional offset throttle element returned elastically by adjustable means in dependence on various parameters, such as atmospheric temperature and pressure, temperature of a post-combustion device, concentration of polluting gases, etc.

f. The needle slides inside a tube terminating in the adjustable aperture, and this tube is partly accommodated in the constant level chamber, below the level of petrol.

In this manner the expansions of the tube and of the needle are reduced in absolute value, and they take place in the same direction, thus avoiding the relative displacements of the aperture and needles due to differential expansions.

BRIEF DESCRIPTION OF THE DRAWINGS

So that the invention will be better understood it will now be more fully described with reference to the accompanying drawings, in which.

DETAILED DESCRIPTION OF A PREFERRED EMBODIMENT

Figure 1:
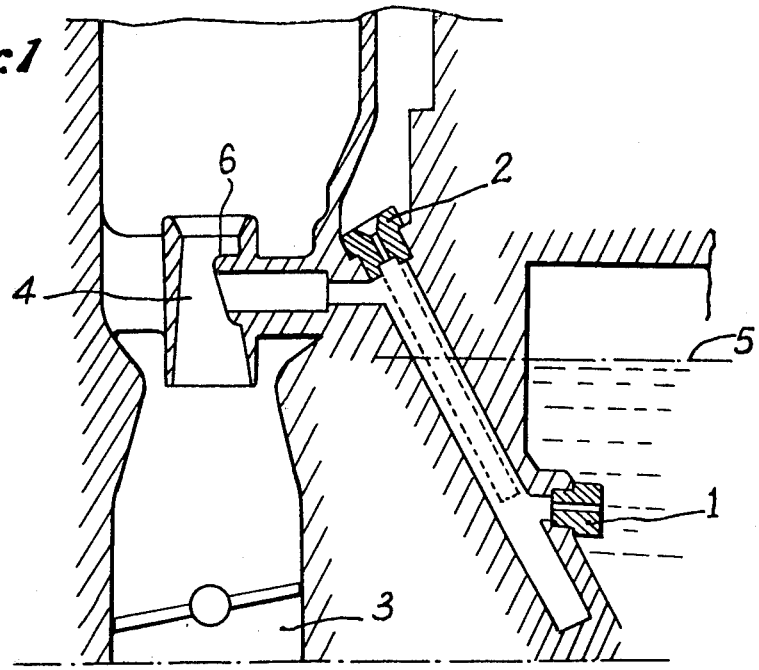
FIG. 1 is a diagrammatical section of a fixed jet carburetor of conventional type.
Figure 2:
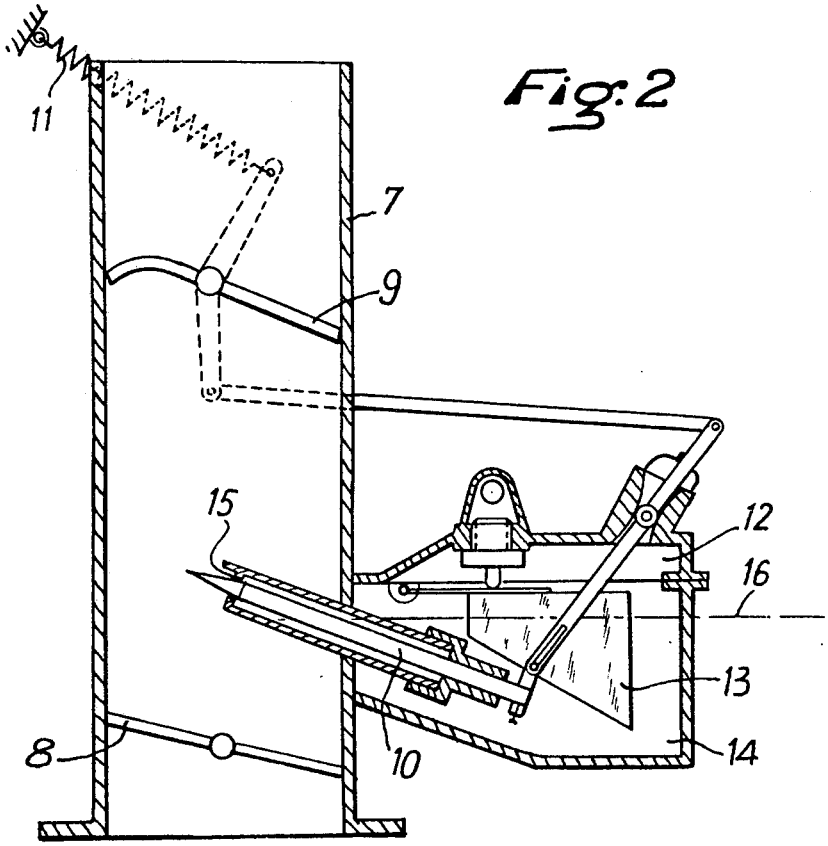
FIG. 2 is a diagrammatical longitudinal section of an example of a carburetor according to the invention.

Referring to FIG. 2, it is seen that the carburetor of the invention is of the constant vacuum type in which the body 7 contains a main throttle 8 operated by the driver, and an auxiliary throttle 9 which is offset and held by a return means 11 in such a manner that the throttle 9 opens automatically and progressively in proportion as the flow of air in the body 7 increases, so as to keep substantially constant the vacuum prevailing between the two throttles 8 and 9; the throttle 9 controls the needle 10 adjusting the opening of the aperture 15 and controls the flow of fuel coming from the chamber 12, in which it is kept at a constant level by the float 13. In known carburetors of this kind the aperture 15 is not situated in the body of the carburetor and the fuel 14 is discharged into the body 7 through the end of a passage connected to the adjustable aperture 15.

According to the invention, on the other hand, the aperture 15 controlled by the needle 10 discharges directly into the body 7. Consequently, it is the aperture 15 itself which is situated in the body 7 and this aperture is centered on the diametrical axis of the stream of air passing through the body 7.

Furthermore, the petrol clearance height, which is the distance between the aperture 15 and the petrol level 16 in the carburetor chamber 12, is not greater than 10 mm.

Since the dimension of parts such as the aperture 15 and the needle 10 is not negligible, the condition of centering the aperture 15 on the geometrical axis of the body 7 can be considered as fulfilled for the purposes of the invention if the distance between the center of the metering aperture 15 and the axis of the body 7 is not greater than 5 mm.

Results are however far superior when this distance does not exceed 2 mm, as can be seen from the curves in FIGS. 5 to 8.

Figure 5:
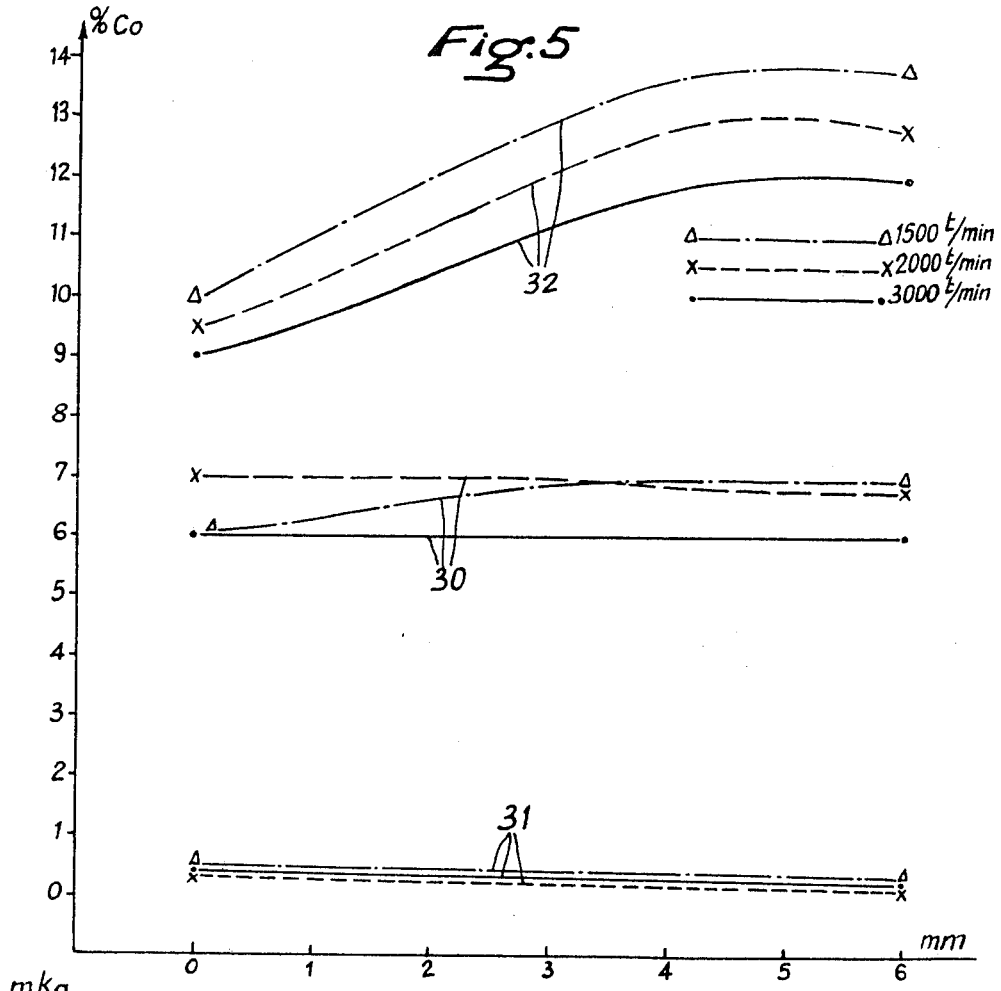
FIGS. 5 to 8 are graphs illustrating the improvement of the distribution of petrol between the cylinders as the result of the invention, and also its incidence on torque.

FIG. 5 illustrates the results of comparative tests relating to the influence of the distance between the outlet of the petrol injection aperture and the axis of the air stream at full load. The tests were carried out by placing the petrol jet aperture at successive distances of 0, 1, 2, 3, 4, 5, and 6mm. from the said axis, the carburetor being adjusted on each occasion so as to keep at the same value (6 to 7%) the total percentage of CO recorded in the exhaust (curves 30). This distance between the jet aperture and the axis of the body is shown on the abscissa.

By measuring and plotting on the ordinate the percentages of CO measure on each cylinder, it is thus possible to observe how the distribution between the cylinders evolves.

For the poorest cylinder (curve 31) the CO content, which was originally very low, varies very little, but it is seen that the percentage of CO observed on the richest cylinder (curve 32) increases very substantially (from 9% to 12%).

Figure 6:
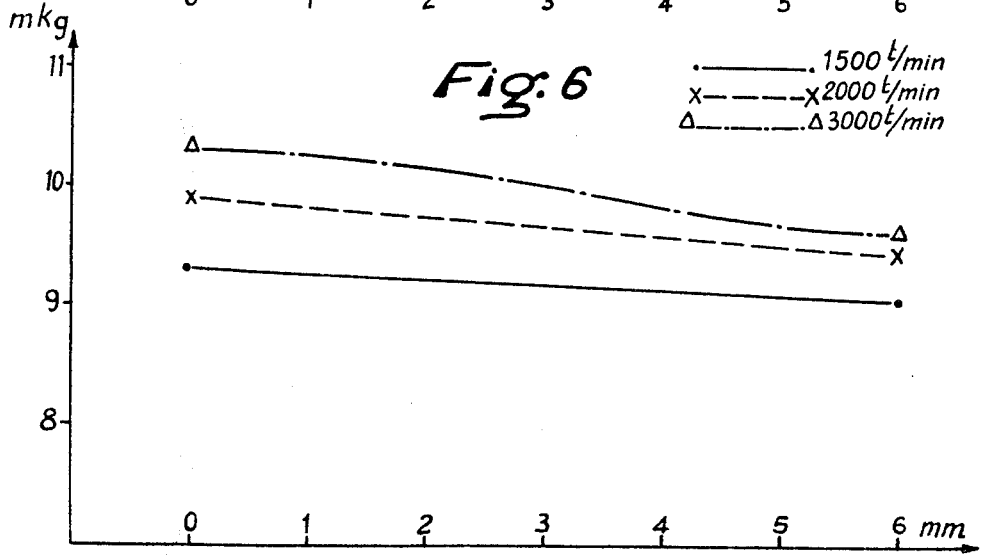

FIG. 6 shows the corresponding evolution of the torque, which decreases very substantially.

Figure 7:
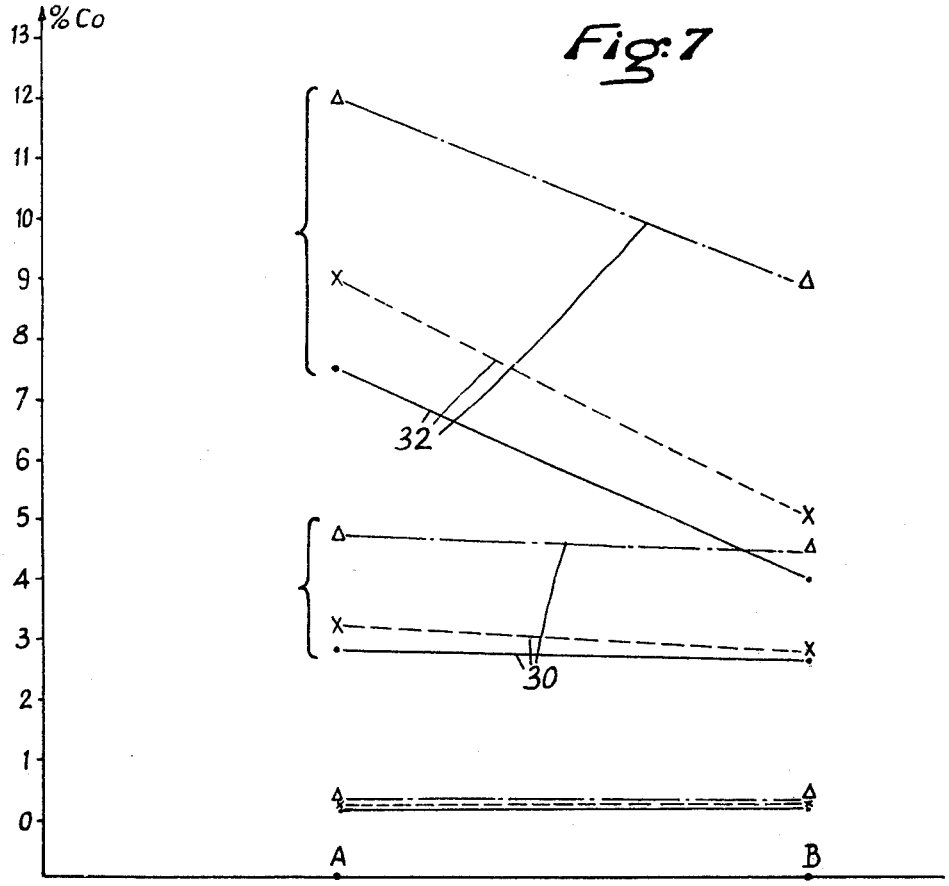
Figure 8:
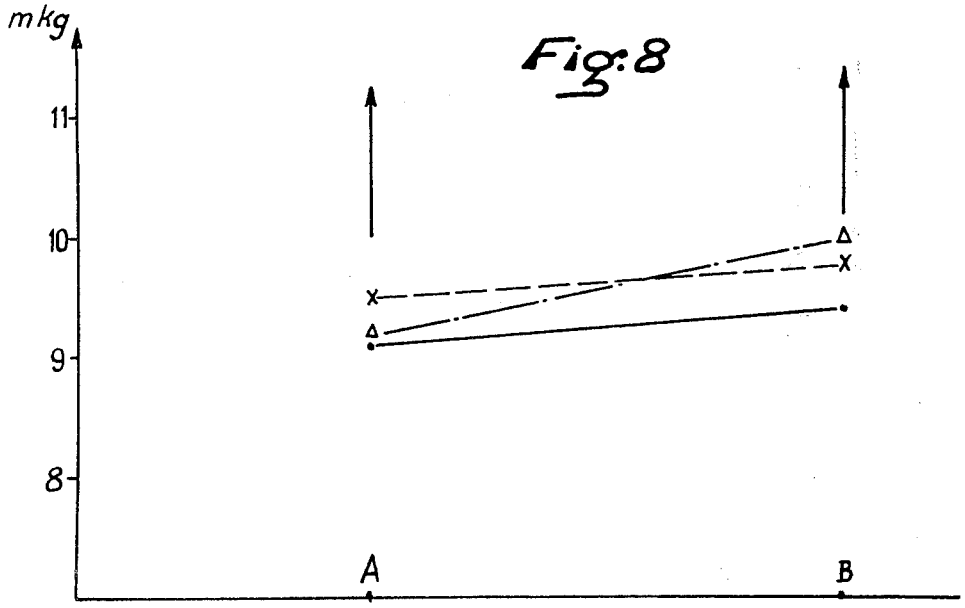

FIG. 7 shows the comparison between two forms of petrol supply. On the vertical abscissa A are plotted the results obtained with conventional spraying with a fixed jet, and on the vertical abscissa B the results obtained with a constant vacuum carburetor provided with the devices of the invention.

As in the tests of FIG. 5, carburation was on each occasion so adjusted as to obtain identical mean values for the CO content of the combustion gases (lines 30), and the differences in distribution in the different cylinders can be seen (at medium load, percentage of CO of the order to 3 to 5 depending on speeds).

It is seen that the dispersion of the distribution between the cylinders is considerably reduced with carburetor B according to the invention (lines 32 connection values observed on the richest cylinder in both cases). (These results are reflected in FIG. 8, where the corresponding values of torque are shown).

Figure 3:
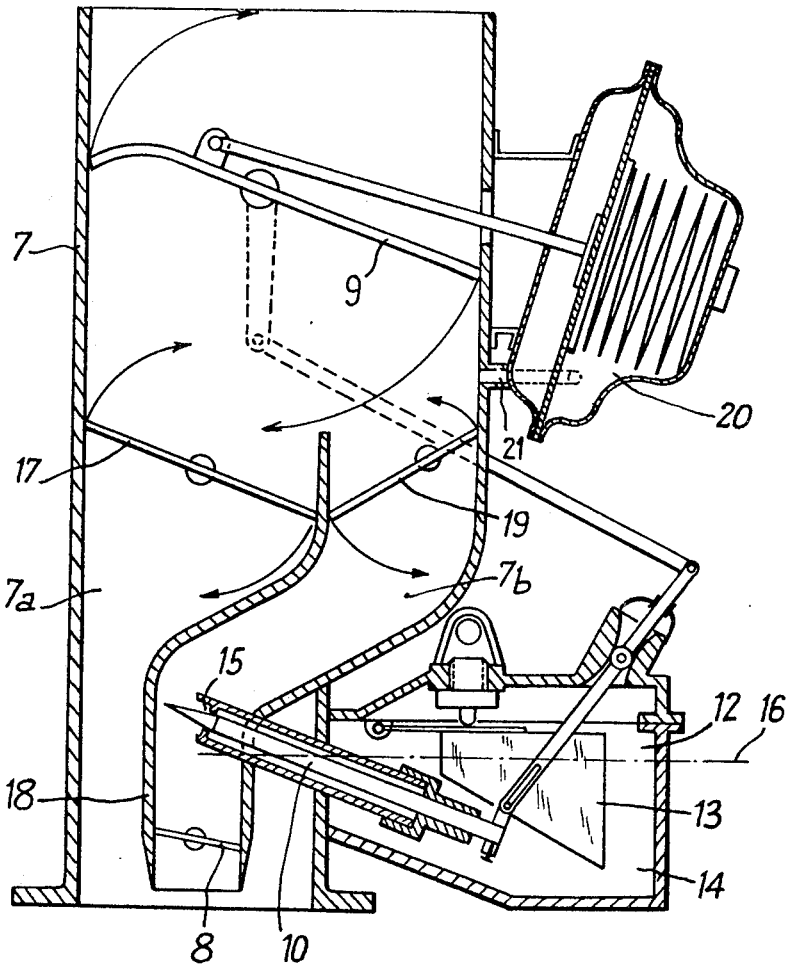
FIG. 3 is a diagrammatical longitudinal section of a twin-body carburetor according to the invention.

FIG. 3 illustrates a twin-body carburetor according to the invention. In this example the body 7 is divided into a main body **7*a* and an auxiliary body 7*b*, both of which are situated downstream of the auxiliary throttle 9. The throttle 8 operated by the driver is situated in the auxiliary body 7*b*, together with the aperture 15 and the needle 10. The main body 7*a* contains a main throttle 17 arranged to open with a time lag in relation to the throttle 8**, this being achieved by any suitable means.

According to the invention the auxiliary body **7*b* is so shaped and disposed that its downstream portion 18 is inside and coaxial to the main body 7*a*; the aperture 15 discharges directly into this portion 18 and it is centered on the geometrical axis of the said portion 18**.

This embodiment therefore provides double centering, that is to say centering of the aperture 15 in the downstream portion 18 of the body **7*b* and centering of the downstream portion 18 in the main body 7*a***.

Furthermore, in this embodiment the two throttles 8 and 17 are joined by a connection (not shown) such that the throttle 17 opens only after the throttle 8 has opened to a selected angle; the body **7*b* contains an additional throttle 19, which is offset, situated upstream of the aperture 15, and returned by means which are adjustable in accordance with various parameters, such as atmospheric pressure and temperature, engine temperature, temperature and/or CO content of the exhaust gases, etc.; and the trottle 9 is subjected to the correcting action of the vacuum prevailing immediately upstream of the said throttle by means of the pressure capsule 20, which is subjected to this vacuum through the passage 21 leading into the body 7 between the throttle 9 and the throttles 17 and 19**.

The combination of all these arrangements provides an improved carburetor and particularly high performance in respect of pollution.

Figure 4:
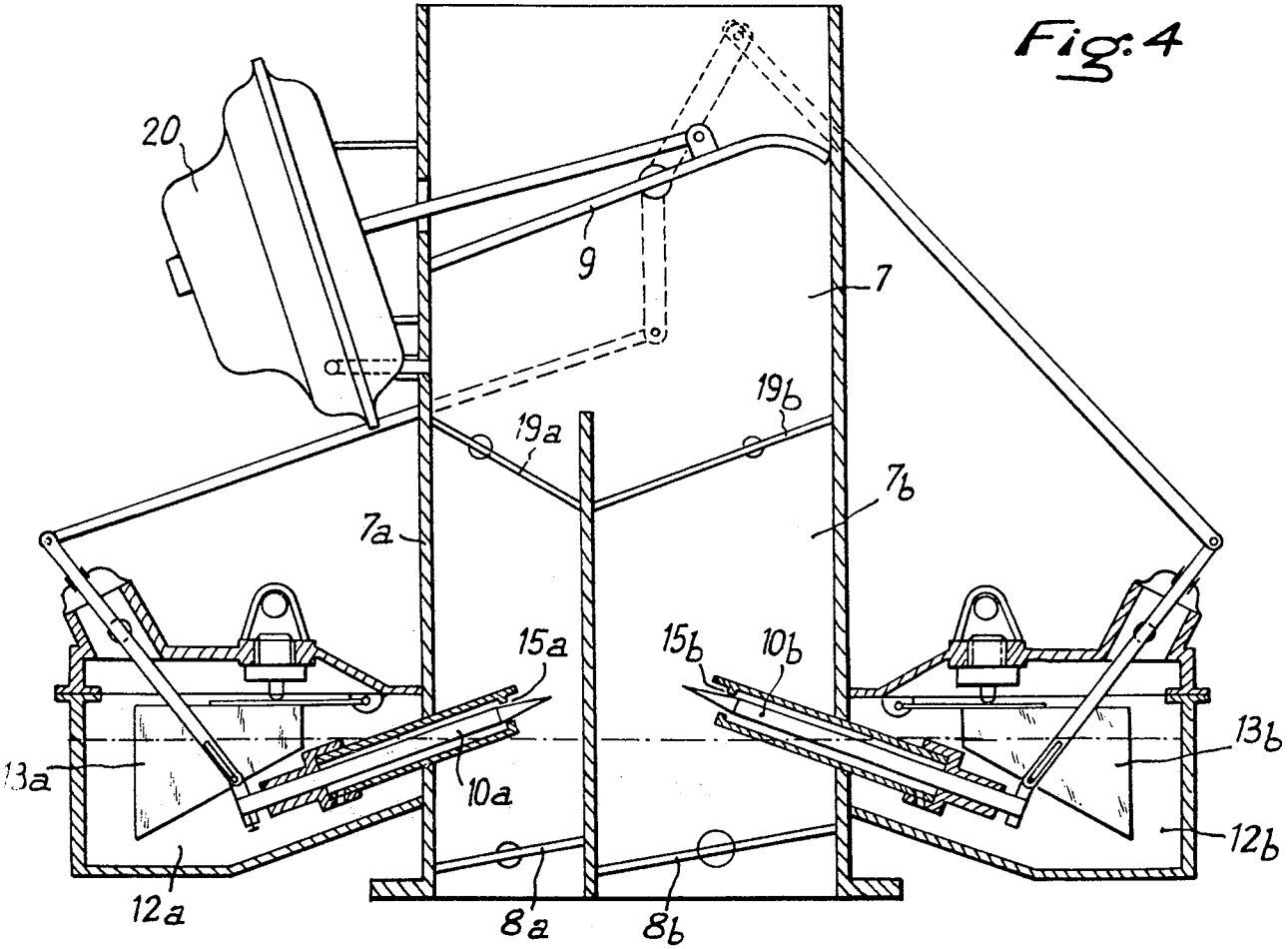
FIG. 4 is a diagrammatical longitudinal section of another carburetor according to the invention, for a stratified charge engine.

FIG. 4 illustrates the application of the invention to stratified charge engines, in which it is necessary to provide double carburation.

It is well known that in the so-called stratified charge engine technique it is necessary to provide double carburation:

1. Rich carburation for supplying the zone near the sparking plug, which zone may be an integral part of the chamber of an antechamber (in the latter case the antechamber may be separately supplied by a third valve);

2. Weak carburation in the main chamber outside the sparking plug zone.

The advantage of a solution of this kind consists of the low emission of polluting substances in the exhaust gas because of the operation with a weak mixture, but the main difficulty comprises this double carburation, which necessitates a double circuit requiring different adjustments of richness.

According to the invention each mixture zone, for example the antechamber and the main chamber, is supplied separately by each of the two bodies of a twin-body carburetor of the type shown if FIG. 4.

Since the two bodies are in communication in the common chamber in which the constant pressure is controlled by the throttle 9 on the one hand and since on the other hand they are subjected to the same engine vacuum, the flow will be proportional to the ratio of the sections.

In a carburetor of this kind each body 7a, 7b, has its own metering system 10a, 12a, 13a, 10b, 12b, 13b both being controlled by the throttle 9, while each adjustable aperture 15a, 15b determining the flow of petrol discharges directly into the corresponding body 7a or 7b on the geometrical axis of the stream of air passing through it, the petrol clearance height being at most equal to 10 mm for each aperture 15a, 15b.

The different richnesses in the body 7a and 7b will be obtained by different laws of regulation of the apertures 15a and 15b.

The main throttles 8a and 8b are both controlled direct by the driver.

It will be advantageous for each body 7a, 7b to have an additional offset throttle 19a, 19b, returned elastically by known means which are not shown (such as a spring) whose return force is adjustable in dependence on parameters such as atmospheric pressure or temperature, concentration of polluting substances (CO or $CO_2$ or $O_2$) in the exhaust gases, or temperature of a post-combustion device.

The aperture 15 and the needle 10 may be arranged in different ways. Nevertheless, the fact that the aperture 15 and the end of the needle 10 are situated in the body 7 reduces the defects or variations of adjustment which may arise from variations of temperature to which these elements are subjected, particularly as the atomization takes place at least in part on the tip of the aperture 15.

For this reason the invention provides for the needle 10 to be continued inside a tube terminating in the aperture 15. In this way the expansions take place in the same direction, whereas they would take place in opposite directions if the needle were disposed facing the tube. Furthermore the tube in question is partly accommodated in the constant level chamber and below the petrol level, as illustrated. The tube and the needle are thus kept at temperatures very close to one another and in addition the petrol effects the lubrication for sliding movement of the needle in the tube.

We claim:

1. A carburetor of the constant vacuum type comprising:

a body defining an air passage, first means carried by said body and defining a main air passageway of predetermined cross-sectional area and forming part of said air passage at a predetermined location therealong, second means carried by said body and defining an auxiliary air passageway of predetermined cross-sectional area and forming the remaining part of said air passage at said predetermined location therealong, an auxiliary throttle in said air passage upstream of both said main air passageway and said auxiliary air passageway, means defining a chamber for containing petrol, a petrol metering element in communication with said petrol chamber and having an adjustable aperture located in said auxiliary air passageway for discharging petrol from said petrol chamber into said auxiliary air passageway, said adjustable aperture being located substantially coincident with the centroid of the predetermined cross-sectional area of the auxiliary passageway for discharging petrol substantially centrally of the air stream flowing through said auxiliary passageway, a first main throttle element carried by said body in said main air passageway, a second main throttle element carried by said body in said auxiliary passageway and downstream of said adjustable aperture, means coupling said auxiliary throttle in said air passage and said petrol metering element for adjusting the petrol flow through said aperture in accordance with the flow of air through said air passage past said auxiliary throttle element, said main air passageway and at least a downstream portion of said auxiliary passageway containing said adjustable aperture being substantially coaxial one with the other with said downstream portion of said auxiliary passageway lying within said first means, said adjustable aperture being located substantially coincident with the substantially common axes of said main air passageway and the downstream portion of the auxiliary passageway.

2. A carburetor according to claim 1 including a throttle element in said auxiliary passageway upstream of said adjustable aperture.

3. A carburetor according to claim 1 wherein second means includes an upstream portion laterally offset from said downstream portion thereof defining a laterally offset part of said auxiliary air passageway, and a throttle element in said laterally offset upstream part of the auxiliary air passageway.

4. A carburetor according to claim 1 including means for sensing a pressure condition in said air passage upstream of said main and auxiliary passageways and providing an output proportional thereto, and means coupled to said sensing means and responsive to said output for controlling said auxiliary throttle.

5. A carburetor according to claim 1 wherein said second means includes an upstream portion laterally offset from said downstream portion thereof defining an offset upstream part of said auxiliary air passageway, a throttle element in said laterally offset upstream part of the auxiliary air passageway, means for sensing a pressure condition in said air passage upstream of said main and auxiliary passageways and providing an output proportional thereto, and means coupled to said sensing means and responsive to said output for controlling said auxiliary throttle, the difference in elevation between the level of the petrol in said chamber and said aperture being not greater than about 10 mm, the distance between the aperture of said petrol metering element on the one hand and the substantially common axes of said main air passageway and the downstream portion of said auxiliary passageway on the other hand being smaller than 2 mm.

6. A carburetor according to claim 1 wherein the lateral distance between the aperture of said petrol metering element on the one hand and the centroid of the cross-sectional area of said auxiliary passageway and the central portion of the air stream flowing through said auxiliary passageway on the other hand does not exceed 5 mm.

7. A carburetor according to claim 1 wherein said petrol metering element includes a continuous tube lying partly in said chamber and in said auxiliary air passageway with said aperture located adjacent the end thereof in said auxiliary air passageway, a flow adjusting needle slidably received in said tube and terminating in said aperture, the portion of said tube within said chamber at least in part residing at an elevation below the petrol level in said chamber.

* * * * *